United States Patent [19]

Ohno

[11] Patent Number: 4,849,743

[45] Date of Patent: Jul. 18, 1989

[54] DEVICE FOR DETERMINING PLACEMENT OF ELECTRICAL CONNECTOR TERMINALS

[75] Inventor: Kengo Ohno, Yokkaichi, Japan

[73] Assignee: Sumitomo Wiring Systems, Ltd., Japan

[21] Appl. No.: 230,302

[22] Filed: Aug. 9, 1988

[30] Foreign Application Priority Data

Aug. 10, 1987 [JP] Japan ..... 62-123056

[51] Int. Cl.[4] ..... G08B 5/36; G08B 21/00

[52] U.S. Cl. ..... 340/687; 439/490; 324/538

[58] Field of Search ..... 324/538, 158 F; 340/687; 439/488, 489, 490

[56] References Cited

U.S. PATENT DOCUMENTS

| | | | |
|---|---|---|---|
| 3,960,428 | 6/1976 | Naus et al. | 340/687 |
| 4,030,029 | 6/1977 | Cox | 324/66 |
| 4,084,875 | 4/1978 | Yamamoto | 340/687 |
| 4,214,801 | 7/1980 | Cairns et al. | 339/59 R |
| 4,462,155 | 7/1984 | Brunelle et al. | 324/66 |
| 4,658,212 | 4/1987 | Ozawa et al. | 324/158 F |

*Primary Examiner*—Reinhard J. Eisenzopf
*Assistant Examiner*—Anthony L. Miele
*Attorney, Agent, or Firm*—Jordan B. Bierman

[57] ABSTRACT

A device for detecting and indicating the position of a terminal wherein a first detector circuit indicates that the terminal is in the proper receptacle and a second circuit indicates that the terminal is locked in place.

7 Claims, 2 Drawing Sheets

FIG. 4
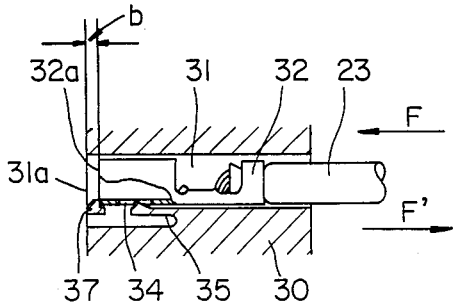
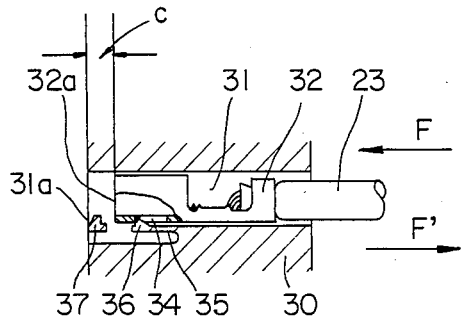
FIG. 5

DEVICE FOR DETERMINING PLACEMENT OF ELECTRICAL CONNECTOR TERMINALS

This Application claims the priority of Japanese Application No. 123,056/87, filed Aug. 10, 1987.

The present invention is directed to a device for determining both the proper placement of an electrical terminal and its degree of insertion into the mating connector housing.

BACKGROUND OF THE INVENTION

The present invention is intended for use in connection with the insertion of a plurality of lead wires into a connector housing wherein each terminal must be specifically placed in a particular cavity and inserted to the proper degree so that it is locked in place and cannot be withdrawn. In particular, the present device is intended for use in insertion of wires into a connector housing having a large plurality of cavities located in rows and columns. The device finds particular usefulness in assembly of wiring harnesses for motor vehicles.

In general, devices which indicate incomplete insertion of a terminal into a cavity of a connector housing are known. In addition, various devices for identifying specific cavities in such housing are also known. The location of the specific desired terminal is determined electrically or by light beams.

In U.S. Pat. No. 4,214,801, a fuse holder is inserted into the terminal block by means of an insertion ramp. An opening for receiving a protrusion extending into the passage is also provided. As can be seen particularly in FIG. 4, the invention is directed to the combination of opening 28 and ramp 210 in fuse holder 20 which is designed to receive protrusion 13 from terminal block 10.

U.S. Pat. No. 4,030,029 teaches the use of lamps for illuminating the second connector cavity. In this test system, an indication is provided at the second location which corresponds to the first location at which sequencing has been stopped. The preferred embodiment teaches a separate lamp to mark each second location. These lamps can be arranged in a pattern corresponding to the pin pattern of the conductor in the event that a plurality of wires to be connected to a single connector unit.

The patent is Brunelle (U.S. Pat. No. 4,462,155) describes a pin locator wherein light emitting diodes are presented in an array that corresponds to the physical arrangement of the proper locations for insertion of the terminals into the connector. The illuminated diode indicates the location at which the terminal is to be inserted.

A terminal examination device with a head having a plurality of probes projecting forwardly therefrom is disclosed by Ozawa in U.S. Pat. No. 4,658,212. The probe has a front portion and a rear portion slidably located in a metallic tube and biased forwardly, leaving a predetermined gap between the probe portions when they are in freed conditions. The front probe portion is moved into the metallic tube to make contact with the rear probe portion when pressed by the corresponding terminal of the connector.

BRIEF DESCRIPTION OF THE INVENTION

In assembling automobile electrical wire harnesses (for example), it is important that the terminal be inserted into the correct cavity in a connector housing.

Thereafter, the terminal should be fully inserted so that it locks in place and does not inadvertently slip out. At the same time, merely inserting the cavity to the proper depth to secure locking is insufficient unless it is placed in the correct location.

Therefore, it is among the objects of the present invention to provide means for determining both proper location and the proper degree of insertion of terminals into a plurality of cavities in a housing.

In accomplishing this, there is a first detection means for identifying the location of the cavity into which a given terminal is to be inserted. A second detection means indicates whether the terminal has been inserted in the cavity to the proper depth so as to obtain the desired locking engagement. In other words, the first means detects the contact of the terminal to a surface of a cylindrical probe which is located on the axis of terminal insertion. This probe is positioned opposite the cavity in which the terminal to be inserted is located.

The present invention comprises a device for detecting the correct location and indicating complete insertion of a terminal in an electrical connector having a plurality of receiving means. Each such means has an electrically conductive hollow receptacle having a longitudinal receptacle axis, an outer end remote from a terminal, and an inner end facing the terminal. An electrical contact is mounted in the receptacle at or near the outer end and is electrically isolated therefrom by suitable insulation. A probe is also located in the receptacle and is slidable along its axis between the electrical contact and the terminal. The probe includes an outer contact facing the outer end and an inner contact facing the terminal and is slidably located in the receptacle and in electrical contact therewith.

The terminal is adapted to touch the inner contact of the probe when it is located in the contact position. When the terminal is moved to its locking position, it causes the outer contact of the probe to touch the electrical contact. Preferably, there is a stop to limit the sliding movement of the terminal in the direction of the receptacle. An electrical circuit is provided which extends from the receptacle to the terminal, passing through the contact indicator and the power source. An additional electrical circuit is provided, in parallel with the first circuit, which runs from the electrical contact to a point on the first circuit between the contact indicator and the power source. Between this point and the electrical contact, the circuit passes through the locking indicator.

When the terminal touches the inner contact (its contact position), the first circuit is completed and current flows through the terminal, the probe, the receptacle, and the first circuit (including the connection) which, if the receptacle is the correct one, activates the contact indicator. The terminal is then inserted further into the receptacle and forces the probe into contact with the electrical contact. This completes the second circuit so that current will flow through the terminal, the probe, the electrical contact, and the second circuit to activate the locking indicator.

Insofar as the relative locations of the various elements of this device are concerned, it is believed that they are rendered clear to the person of ordinary skill by the present specification. However, it should be noted that, for best results, the device of the present invention should satisfy the following relationships:

$$a + b < X \leqq C \quad (1)$$

$$c < d \quad (2)$$

In the foregoing, a is the distance between the electrical contact and the outer contact as shown in FIG. 1, b is the distance between the front end of the terminal and the front surface of the cavity as shown in FIG. 4, c is the distance between the front end of the terminal and the front surface of the cavity when the terminal is in its initial position as shown in FIG. 5, and d is the distance between the initial position and the locking position.

BRIEF DESCRIPTION OF THE DRAWINGS

FIG. 4 is a diagrammatic cross-sectional view showing a typical locking means with the terminal in the fully locked position;

FIG. 5 is a view similar to that of FIG. 4 showing the terminal in its initial position.

DETAILED DESCRIPTION OF THE INVENTION

Figure 1:
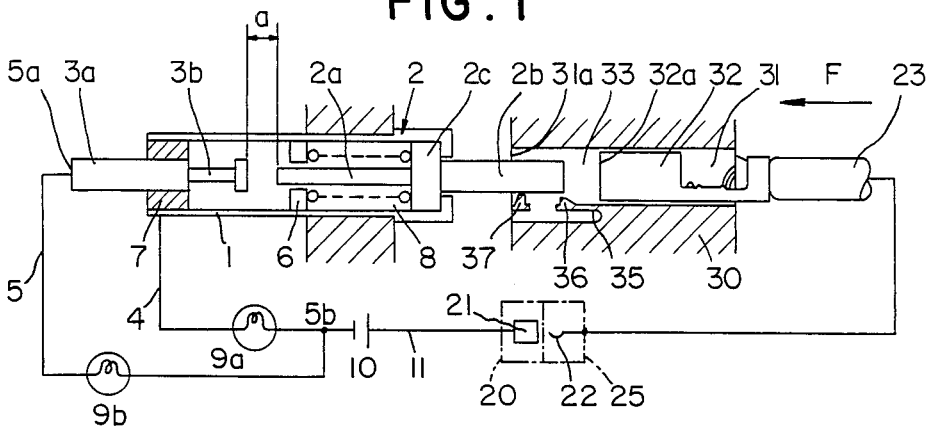
FIG. 1 is a diagrammatic cross-sectional view showing both halves of the connection with the probe partially inserted into the cavity of the terminal.
Figure 2:
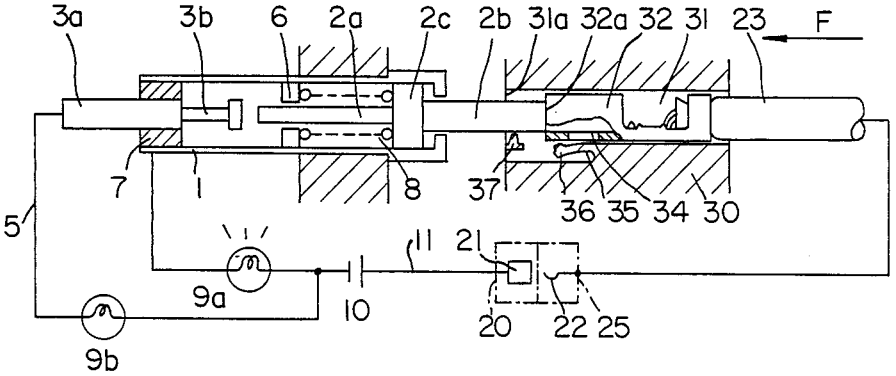
FIG. 2 is a view similar to that of FIG. 1 wherein the terminal has made contact with the probe and the contact indicator has been activated to show that this is the proper receptacle for this terminal.
Figure 3:
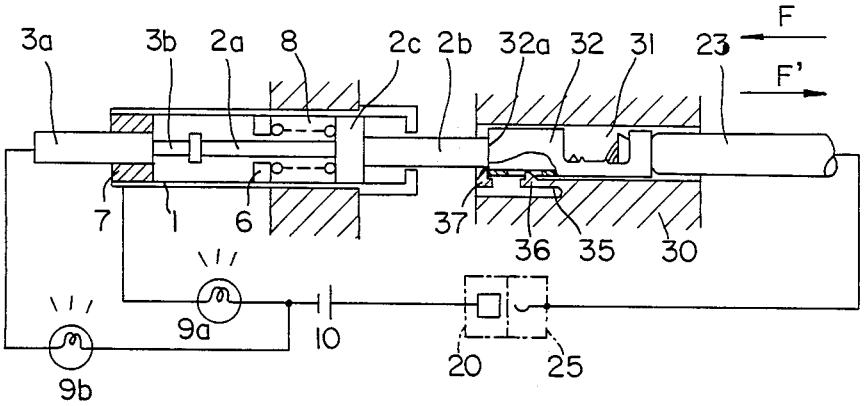
FIG. 3 is a view similar to that of FIG. 2 wherein the terminal has been fully inserted into its appropriate cavity and both the contact indicator and the locking indicator have been activated.

As can best be seen in FIGS. 1 to 3, conductive receptacle 1 has slidable probe 2 located therein. Probe 2 comprises outer contact spindle 2*a*, inner contact spindle 2*b*, and flange 2*c* located therebetween. At the opposite end of receptacle 1 is electrical contact 3*b* having an external end 3*a*. Contact 3*b* is isolated from receptacle 1 which is electrically conductive by insulation 7.

Bearing 6 is located in receptacle 1 intermediate the ends thereof. Between flange 2*c* and bearing 6 is positioned spring 8 urging probe 2 away from contact 3*b*.

Terminal 32 is slidably located in passage 33 of cavity 31 in connector housing 30. Terminal 32 has front end 32*a* and cavity 31 is provided with front surface 31*a*.

Opening 34 in terminal 32 is adapted to receive projection 36 carried by resilient arm 35.

First electrical circuit 4 extends from receptacle 1 through contact indicator 9*a*, power source 10, connector housing 20, to lead wire 23. In parallel therewith is second electrical circuit 5 extending from circuit end 5*a* through locking indicator 9*b* to circuit 4 at point 5*b*.

Initially, as shown in FIG. 1, cavity 31 having terminal 32 therein is aligned with receptacle 1. At this point, no contact has been between terminal 32 and inner spindle 2*b*. Housing 30 is then moved in direction F until the device assumes the position shown in FIG. 2. Contact has now been made between terminal 32 and inner spindle 2*b*. This completes first circuit 4 so that current will flow from terminal 32 through spindle 2, flange 2*c*, receptacle 1, wire 11, contact indicator 9*a*, connector housing 20 to lead wire 23. Since the circuit is complete, if receptacle 1 is the proper location for terminal 32, contact indicator 9*a* (in this case a lamp) will light.

The two parts of the device are pressed further together to the position shown in FIG. 3. Terminal 32 now abuts stop 37 preventing it from sliding further with respect to cavity 33. Projection 36 on resilient arm 35 has enters opening 34 in terminal 32; this locks terminal 32 in place.

At the same time, the pressure of terminal 32 against inner spindle 2*b* has caused flange 2*c* to slide toward contact 3*b*. Outer spindle 2*a* now touches contact 3*b* completing second electrical circuit 5. Current then flows from terminal 32 through inner spindle 2*b*, flange 2*c*, outer spinder 2*a*, contact 3*b*, external end 3*a*, locking indicator 9*b*, and back to wire 11 of second circuit 4.

When terminal 32 is in this position, current flows in both circuit 4 and circuit 5 causing contact indicator 9*a* and locking indicator 9*b* to light up. It is assured that (1) terminal 32 is in the correct receptacle and (2) it has been fully inserted and locked therein.

Referring more specifically to FIGS. 4 and 5, the locking mechanism for terminal 32 is shown more clearly. As terminal 32 slides in direction F, projection 36 on resilient arm 35 is permitted to enter opening 34 as shown in FIG. 5. The movement in direction F is continued until front end 32*a* abuts stop 37 as shown in FIG. 4.

In using the device of the present invention, wires 23, having electrical terminals at both ends, are placed on a suitable support on which a wiring chart is located. One end of each of the lead wires 23 is usually connected to one of a plurality of receiving terminals in connection 20 such as cavity 21. This is possible because a single set of wires is used for various kinds of wiring assembles independent of model differences, etc. Thus, when the other end of a wire is inserted into the correct receptacle, the circuit is completed and contact indicator 9*a* will light. Thus, the present invention supplies a simple and virtually foolproof means for making multiple connections of the type described.

While only a limited number of specific embodiments of the present invention have been expressly disclosed, it is, nonetheless, to be broadly construed and not to be limited except by the character of the claims appended hereto.

I claim:

1. A device for detecting and indicating a contact position and a locking position of a terminal in an electrical connector comprising an electrically conducting hollow receptacle having a longitudinal receptacle axis, an outer end remote from said terminal, and an inner end toward said terminal, an electrical contact mounted in said receptacle adjacent said outer end and electrically isolated from said receptacle, a probe in said receptacle between said electrical contact and said terminal and slidable along said axis, said probe comprising an outer contact toward said outer end and an inner contact toward said terminal, said probe fitting slidably in said receptacle and in contact therewith, said terminal adapted to touch said probe in said contact position and to cause said probe to touch said electrical contact in said locking position, a first electrical circuit extending from said receptacle through a contact indicator to said terminal, there being a power source in said first circuit, a second electrical circuit extending from said electrical contact through a locking indicator to a point in said first circuit between said contact indicator and said power source, whereby, when said terminal contacts said inner contact in said contact position, current flows through said terminal, said probe, said receptacle, and said first circuit to cause said contact indicator to be activated and, when said outer contact contacts said electrical contact in said locking position, current flows through said terminal, said probe, said electrical contact, and said second circuit to cause said locking indicator to be activated.

2. The device of claim 1 wherein said probe comprises an outer spindle extending toward said outer end, an inner spindle extending toward said terminal, and a flange slidably fitting in said receptacle and in contact therewith.

3. The device of claim 1 wherein said terminal has a longitudinal terminal axis substantially aligned with said receptacle axis, an opening in said terminal, a resilient arm extending substantially parallel to said terminal axis and carrying a projection thereon, an opening in said terminal complementary to said projection and extending longitudinally of said terminal.

4. The device of claim 3 wherein said terminal is in a cavity in a housing, said housing having a front surface nearest said receptacle, said arm is on an inner wall of said cavity, whereby said projection enters said opening when said terminal is in an initial position before said terminal contacts said step.

5. The device of claim 4 which satisfies the relationships $$a + b < X \leqq C \quad (1)$$

$$c < d \quad (2)$$

wherein a is the distance between said electrical contact and said outer contact when said probe is in its remotest position from said outer end, b is the distance between said front end of said terminal nearest said electrical contact and said front surface, c is the distance between said front end of said terminal and said front surface when said terminal is in said initial position, and d is the distance between said initial position and said locking position.

6. The device of claim 1 wherein said probe is urged toward said terminal.

7. The device of claim 1 wherein there is a flange between said inner contact and said outer contact, a bearing between said flange and said electrical contact, and a resilient means between said flange and said bearing urging said probe toward said terminal.

* * * * *